United States Patent [19]

Winston et al.

[11] Patent Number: 4,473,962

[45] Date of Patent: Oct. 2, 1984

[54] COMBINED DEVICE AND CONTEST INDICIA

[76] Inventors: Emanuel A. Winston, 871 Manon, Highland Park, Ill. 60035; Russell S. Guertin, 1041 Cobblestone Ct., Northbrook, Ill. 60062

[21] Appl. No.: 341,288

[22] Filed: Jan. 21, 1982

[51] Int. Cl.[3] ..... A44C 3/00

[52] U.S. Cl. ..... 40/2 R; 40/1; 273/139

[58] Field of Search ..... 40/311, 306, 312, 307, 40/2 R, 124.1, 310, 616, 323, 17.5, 539, 53 C, 1; 46/17, 22; 283/12 A, 49, 50, 51, 52, 6; 273/139

[56] References Cited

U.S. PATENT DOCUMENTS

| | | | |
|---|---|---|---|
| 2,155,814 | 4/1939 | Wolfe | 283/49 |
| 2,188,310 | 1/1940 | Price | 40/2 R |
| 2,349,706 | 5/1944 | Collins | 40/538 |
| 3,314,693 | 4/1967 | Flam | 283/49 |
| 3,524,271 | 8/1970 | Buske | 40/2 R |
| 3,558,138 | 1/1971 | Lemelson | 273/157 R |
| 3,986,283 | 10/1976 | Pelaez | 40/616 |
| 4,095,824 | 6/1978 | Bachman | 273/139 |
| 4,161,833 | 7/1979 | Wagner | 40/539 |
| 4,307,900 | 12/1981 | Kroutsack | 40/306 |

*Primary Examiner*—Gene Mancene
*Assistant Examiner*—Cary E. Stone
*Attorney, Agent, or Firm*—Frijouf, Rust & Pyle

[57] ABSTRACT

A combined device and contest indicia is disclosed comprising an article or apparatus having an intrinsic utility within the article or apparatus. The invention comprises an integrally affixed indicia indicating the results of a participating contest or game. The indicating indicia may be molded, raised, embossed or the like on a surface of the article or apparatus.

5 Claims, 12 Drawing Figures

COMBINED DEVICE AND CONTEST INDICIA

BACKGROUND OF THE INVENTION

1. Field of the Invention

This invention relates to an article or an apparatus and more particularly to an article or an apparatus having an intrinsic utility combined with a marking indicia integrally disposed thereon for indicating the result of a contest or a game.

2. Background of the Invention

Various types of contests and games have been devised by the prior art to enhance the purchase or marketability of various types of products. Some in the prior art have utilized game cards incorporating secret indicia thereon for revealing the result of a contest or game. These game cards were typically distributed from the retailer either in person or by mail in an attempt to generate consumer interest in the product as well as invite attendance at the place of business of the merchant sponsoring or participating in the contest or game. For example, many in the prior art have utilized game cards with secret indicia thereon for encouraging attendance at the place of business of the merchant to provide an opportunity to sell other goods to the consumer. The secret game card comprised a cardboard sheet of written material incorporating a secret indicia thereon indicating whether a participating consumer was a prize winner upon removing an overcoating on the secret indicia. The attendance at the place of business of the merchant encouraged consumer purchase and the consumer was encouraged to visit the establishment of the merchant by virtue of the likelihood of winning in the contest or game. Various types of vendors have incorporated this type of promotional contest or game to generate additional business for the merchant or vendor.

Unfortunately, the aforementioned game cards do not have an intrinsic utility. Most of these game cards were immediately discarded upon the realization that the game card did not include a favorable or winning indicia thereon. Accordingly, these game cards represented a substantial consumer waste since the game card had no value once an unfavorable indicia was revealed.

It is a primary purpose of the present invention to provide a device for providing a useful article or apparatus incorporating a contest or game indicating indicia thereon whereby the consumer enjoys the use of the useful article or apparatus even if the indicating indicia thereon reveals an unfavorable result in the contest or game.

Another object of this invention is to provide a combined device and contest or game indicia which provides a low cost and useful device in the event that the prize winning indicia is unfavorable to the consumer.

Another object of this invention is to provide a combined device and contest or game indicia where the indicia may be integrally incorporated within the device whereby the device may act as a premium distributed with the purchase of another.

Another object of this invention is to provide a combined device and contest or game with the contest or game winning indicia disposed integrally on a conventional article or apparatus whereby the consumer receives the potential of winning the contest or game prize and the manufacturer expends only nominal funds in marking only selected ones of the articles or apparati produced in the normal course of business.

Another object of this invention is to provide a combined device and contest or game wherein the consumer may purchase the device at a conventional cost in addition to having the potential of winning a prize in the contest or game.

Another object of this invention is to provide a combined device and contest or game whereby the manufacturer may incorporate the contest or game into a conventional device without the need of separate game cards or the like.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention may be incorporated into a combined device and contest or game comprising a utility device incorporating either an article or an apparatus having an intrinsic utility within the article or apparatus. The device includes an indicating indicia thereon integrally formed therewith indicative of the result of the contest or game. The indicating indicia may be molded, raised, embossed or otherwise integrally disposed on the article or apparatus for providing a combined utilitarian article or apparatus and a potentially prize winning indicia for the consumer.

In more specific embodiments of the invention, the invention may be incorporated into either premium items which are incorporated into a separate and distinct consumer product or in the alternative may be integrally disposed upon a conventional consumer product. In one embodiment of the invention, the device incorporates an apparatus or article such as a premium item, in an assembled or unassembled form having the prize indicating indicia disposed integrally thereon. In another example of the invention, the invention may be incorporated into a conventional consumer product such as a household or consumer item with an identifying indicia thereon in the event of a favorable result in the contest or game. In the alternative, all conventional consumer products may be marked with identifying indicia and only selected ones of the conventional consumer products indicating a favorable result with the contest or game.

The invention may take various forms with either consumer or premium item with the identifying indicia integrally disposed on the article or apparatus. The indicating indicia is integrally disposed on the device incorporating either an article or apparatus which incorporates a useful product irrespective of the outcome of the indicia incorporated in the device.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in conjunction with the accompanying drawings in which.

Similar reference characters refer to similar parts throughout the several views of the drawings.

DETAILED DESCRIPTION

Figure 1:
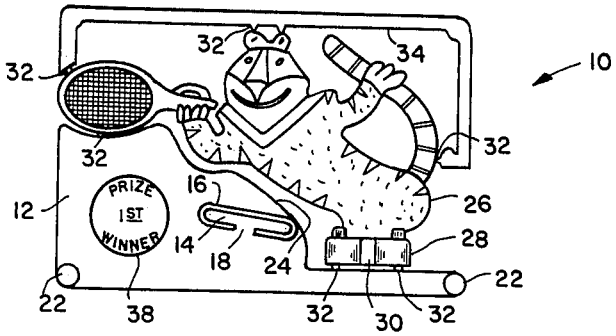
FIG. 1 illustrates a first embodiment of the invention showing a premium item in the unassembled position.
Figure 2:
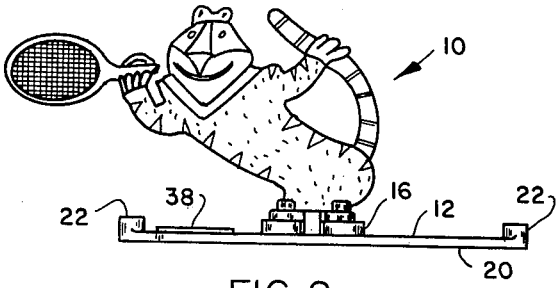
FIG. 2 is a front view of the first embodiment of the invention in the assembled position.
Figure 3:
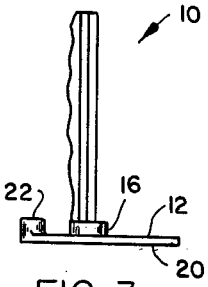
FIG. 3 is a side view of FIG. 2.

FIG. 1 illustrates a plan view of a combined device and contest 10 which may be suitable for use as a premium item or the like. Although the device 10 is disclosed with reference to a premium item, it is understood that the device may be a device suitable for sale as should be well known to those skilled in the art. The device 10 comprises a base 12 having a recess 14 defined by a boss 16 having a keyway 18. The base 12 is substantially flat with the boss extending upwardly therefrom to provide a flat base surface 20 as shown in FIGS. 2 and 3 for resting on a substantially horizontal supporting surface. Bosses 22 extend upwardly from the base 12 and are for the purpose of molding and form no part of the invention. The base 12 has a cutout surface 24 for cooperation with a body member 26 having a recess insert 28 and a key 30. The body member 26 is molded simultaneously with the base 12 and is retained thereto by frangible tabs 32 which may be easily broken by the consumer for assembling the device as shown in FIGS. 2 and 3. An upper bar 34 is secured by frangible tabs 36 and is incorporated for the purposes of molding the device 10 such that the molded parts are substantially rectangular in the unassembled position. The rectangular periphery enables easy handling for packaging and distribution with automatic machinery as should be well known to those skilled in the art.

FIGS. 2 and 3 illustrate front and side elevational views of the device 10 shown in the assembled position. The consumer merely severs the frangible tabs 32 and 36 thereby separating the body member 26 from the base 12. The recess insert 28 is inserted within the recess 14 with key 30 aligned with keyway 18 enabling the base 12 to support the body member 26 as shown in FIGS. 2 and 3. The upper bar 34 may be discarded thus completing the assembly of the device 10. The device in this embodiment is shown as a tiger caricature which may be distinctive of a certain product and packaged as a premium product within a cereal box or the like. The caricature is three-dimensional as shown in FIG. 3 in contrast to game cards and the like. Preferably, the product is enclosed in a plastic overwrap and is hidden within a container such as a box shown in FIG. 7.

Figure 6:
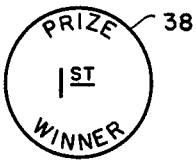
FIG. 6 is an enlarged view of the indicating indicia.

The combined device and contest 10 contains an indicating indicia 38 which is integrally formed in the device and in this embodiment, integrally formed in the base 12 to reveal whether the device 10 is a prize winner in the associated game or contest. FIG. 6 illustrates an enlarged view of the indicating indica 38 indicating a first prize winner. For indicating indica not favorable in the contest or game, the indicating indicia 38 may be absent from the base 12 or may just indicate participation in the game or contest but no favorable result in the contest or game. Although the indicating indicia has been shown as being integrally formed in the base 12 as by embossing, raising or the like, it should be appreciated by those skilled in the art that the indicating indicia may be disposed on the body member 26 or any other suitable place.

Figure 4:
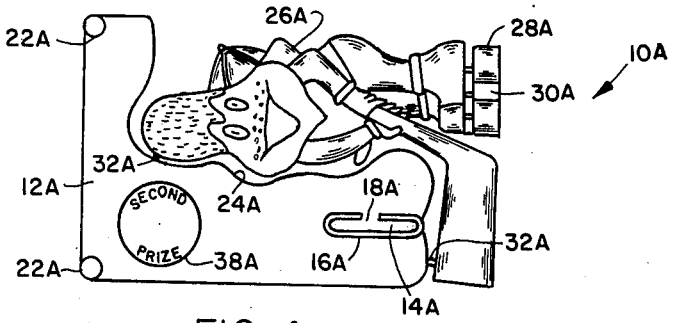
FIG. 4 illustrates a second embodiment of the invention showing the premium item in the unassembled position.
Figure 5:
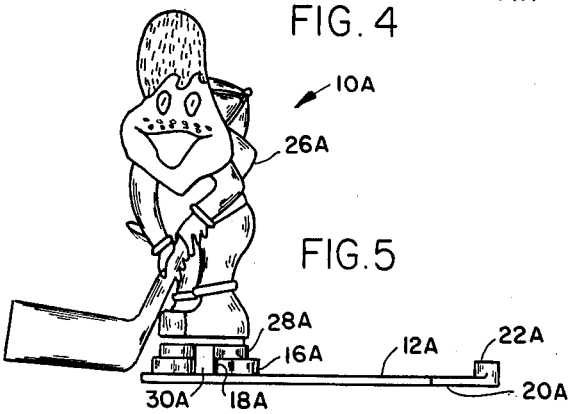
FIG. 5 is a front view of the second embodiment of the invention showing the premium item in the assembled position.

FIGS. 4 and 5 illustrate a second embodiment of the invention of a combined device and contest 10A which may be suitable for use as a premium item and the like. The device 10A comprises a base 12A having a recess 14A defined by a boss 16A having a keyway 18A. The base 12A is substantially flat with the boss extending upwardly therefrom to provide a flat base surface 20A for resting on a substantially horizontal supporting surface. Bossess 22A extend upwardly from the base 12A and are for the purpose of molding and form no part of the invention. The base 12A has a cutout surface 24A for cooperation with a body member 26A having a recess insert 28A and a key 30A. The body member 26A is molded simultaneously with the base 12A and is retained thereto by frangible tabs 32A which may be easily broken by the consumer.

The consumer merely severs the frangible tabs 32A thereby separating the body member 26A from base 12A. The recess insert 28A is inserted within the recess 14A with key 30A aligned with keyway 18A enabling the base 12A to support the body member 26A as shown in FIG. 5. The device 10A in this embodiment is shown as a hockey player which may be packaged as a premium item within a box or the like. Preferably the product is enclosed in a plastic overwrap and is hidden within the container such as the box shown in FIG. 7 to be given to the consumer purchaser of the consumer product.

The combined device and contest 10A contains an indicating indicia 38A which is integrally formed in the device 10A and in this embodiment integrally formed in the base 12A to reveal whether the device 10A is a prize winner in the associated game or contest.

Figure 7:
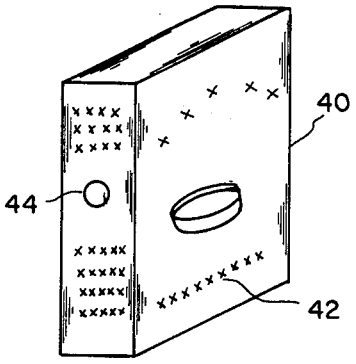
FIG. 7 is a perspective view of a carton suitable for holding premium items.

FIG. 7 illustrates a container 40 which may be utilized with the invention for concealing the indicating indicia 38 on the combined device or contest. The container 40 may contain a statement 42 advertising the device in addition to having a printed item 44 such as a cutout member such as a ball or the like for use with the device. For example, the printed item 44 may be a cardboard tennis ball or hockey puck which may be utilized with the devices as shown in FIGS. 1–5 for providing a complete amusement toy to the consumer.

A fundamental object of the present invention is to provide a premium item or conventional consumer product wherein the absence of a favorable indication of the contest or game still results in a useful device to the consumer. In the embodiments shown in FIGS. 1–5, the absence of a favorable indicating indicia 38 still provides a usable premium item to the purchasing consumer. The fundamental thrust of the present invention resides in the plural benefit to the consumer, namely a usable item in addition to the potential of winning a contest or game.

Figure 8:
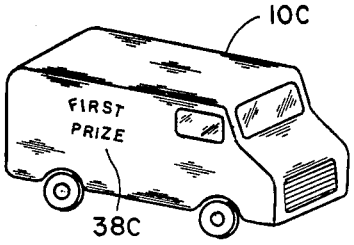
FIG. 8 is a perspective view of a third embodiment showing the invention incorporated into a preassembled premium item.

FIG. 8 illustrates still a third embodiment of the invention showing a toy vehicle 10C in completely assembled form having indicating indicia 38C thereon indicating the results of the game or contest. The indicting indicia 38C may indicate as shown in FIG. 8 a first prize winner or in the alternative, may just indicate participation in the game or contest. In a further alternative, the device 10C may be void of any indicating indicia depending upon the particular application of the game or contest.

Figure 9:
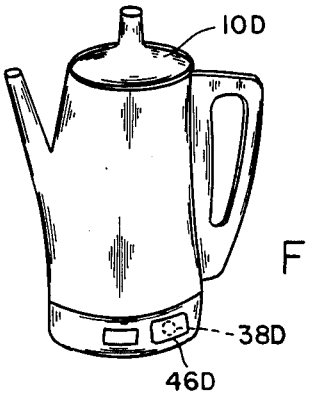
FIG. 9 is a perspective view of a fourth embodiment of the invention incorporated into a preassembled conventional consumer product.

FIG. 9 illustrates a fourth embodiment of the invention showing a conventional consumer product, shown as a coffee pot 10D, with the indicating indicia 38D disposed thereon. In this embodiment, the indicating indicia is overlaid by a removable covering 46D for concealing the content of the indicating indicia 38D. The purchaser of the conventional consumer product 10D has the additional benefit of the potential of winning the game or contest upon removing the removable cover 46D and inspecting the indicating indicia 38D. It should be appreciated by those skilled in the art that if the consumer product is packaged within a box and remains in a sealed condition that the removable cover 46D may or may not be necessary with the use of this invention.

Figure 10:
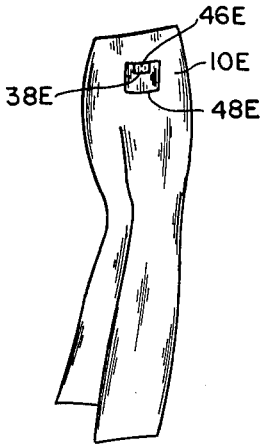
FIG. 10 is an elevational view of a fifth embodiment of the invention wherein the device is incorporated into a preassembled conventional consumer product.

FIG. 10 illustrates a fifth embodiment of the invention showing a garment 10E having a patch 46E disposed on the rear pocket 48E of the garment 10E. It should be well known to those skilled in the art that many manufacturers sew a patch indicating the origin of the goods to the consumer to the rear pocket of slacks.

Figure 11:
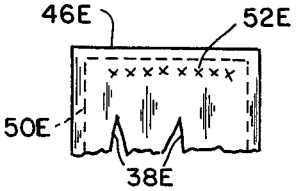
FIG. 11 is an enlarged view of the indicating indicia of FIG. 10.
Figure 12:
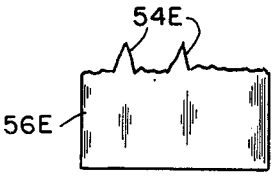
FIG. 12 is an enlarged view of a code indicia for indicating the results of the contest or game.

FIG. 11 is an enlarged view of the patch 46E showing the stitches 50E securing the patch 46E to the rear pocket 48E of the pants 10E. In this embodiment the origin of the goods is indicated at 52E with the bottom portion of the patch 46E having indicating indicia 38E shown as a coded ragged surface. The consumer would purchase the pants 10E and subsequently compare the coded ragged surface 38E with a ragged surface 54 of a code patch 56E for indicating whether the consumer was a prize winner in the contest or game. In this embodiment, the coded member 56E may be made available after the expiration or sale of all of the coded jeans. The consumer would be required to return to the place of business of the merchant to compare the indicating indicia 38E against the code 54E of the coded member 56E. Accordingly, the consumer is required to attend the establishment of the merchant two times in order to ascertain the contest results. This encourages purchasing by the consumer to the benefit of the merchant.

The previous embodiments have set forth various methods and apparati and devices for incorporating the present invention. It should be appreciated by those skilled in the art that the present invention may be applicable to all types of devices wherein a product has an intrinsic usefulness in combination with an integral indicating indicia for revealing the results of a contest or a game. Various variations of this invention may be resorted to by those skilled in the art and it should be appreciated that those variations are within the scope of the present invention.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described, I claim:

1. A combined device and contest in which the device has a further utility which is independent of the use of the device relative the contest, said device and contest comprising in combination:

a body member having three substantial dimensions, said body member depicting a caricature;

a base integrally molded with said body member;

frangible means for connecting said body member and said base together;

support means extending from said base for supporting said body member when said frangible means is broken and said body member is detached from said base;

indicating indicia integrally formed on said base; and a removable covering overlaying said indicia for concealing said indicia.

2. A combined device and contest as set forth in claim 1, wherein said body member and said base are assembled by a user.

3. A combined device and contest as set forth in claim 1, wherein said body member and said base are preassembled.

4. A combined device and contest as set forth in claim 1, wherein said indicating indicia is integrally molded in a surface of said base.

5. A combined device and contest as set forth in claim 1, wherein said indicating indicia comprises a coded indicia on said body member which may be compared to a master coded indicia by the participant of the contest.

* * * * *